United States Patent [19]

Meneghini

[11] Patent Number: 5,066,378

[45] Date of Patent: Nov. 19, 1991

[54] ELECTROLYZER

[75] Inventor: Giovanni Meneghini, Milan, Italy

[73] Assignee: DeNora Permelec S.p.A., Milan, Italy

[21] Appl. No.: 416,719

[22] Filed: Oct. 3, 1989

[30] Foreign Application Priority Data

Feb. 13, 1989 [IT] Italy ..... 19423 A/89

[51] Int. Cl.[5] ..... C25B 9/00; C25B 11/02; C25B 11/03; C25B 15/08

[52] U.S. Cl. ..... 204/237; 204/258; 204/266; 204/283; 204/284; 204/290 R

[58] Field of Search ..... 204/252-258, 204/263-266, 283-284, 237, 290 R

[56] References Cited

U.S. PATENT DOCUMENTS 3,790,465 2/1974 Giacopelli et al. ..... 204/266
3,930,151 12/1979 Shibata et al. ..... 204/283
4,138,295 2/1979 DeNora et al. ..... 204/258 X
4,233,147 12/1980 Giacopelli et al. ..... 204/283 X
4,329,218 5/1982 Sorenson et al. ..... 204/283

*Primary Examiner*—Donald R. Valentine
*Attorney, Agent, or Firm*—Bierman and Muserlian

[57] ABSTRACT

Operation of diaphragm monopolar electrolyzers for chlor-alkali electrolysis is improved by providing at least part of the anodes in their upper portion with hydrodynamic baffles capable of generating a plurality of lifting and downcoming recirculation motions of the mixed anolyte-gas phase and of the anolyte separated from gas, respectively, which baffles are characterized by their superior edge or overflow holes located under the free surface of the anolyte, resulting in a reduction of the cell voltage and an increase in the faradic efficiency and the quality of the products.

17 Claims, 10 Drawing Sheets

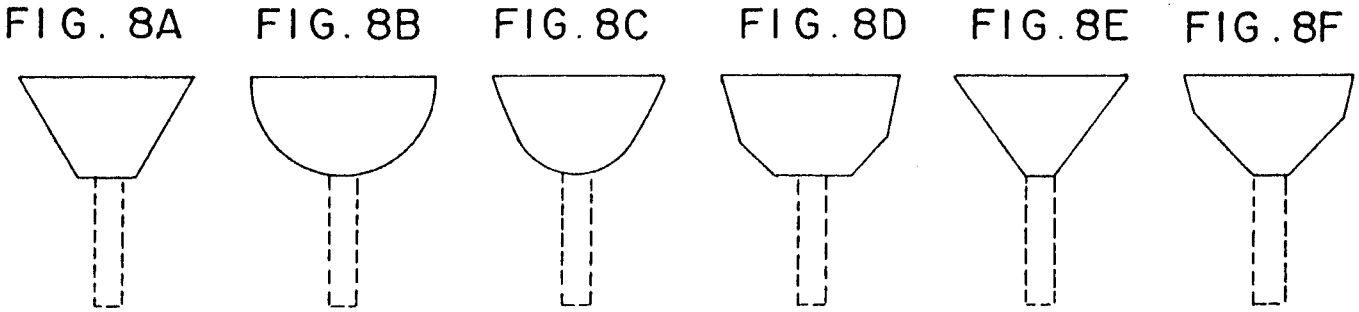
FIG. 8A
FIG. 8B
FIG. 8C
FIG. 8D
FIG. 8E
FIG. 8F
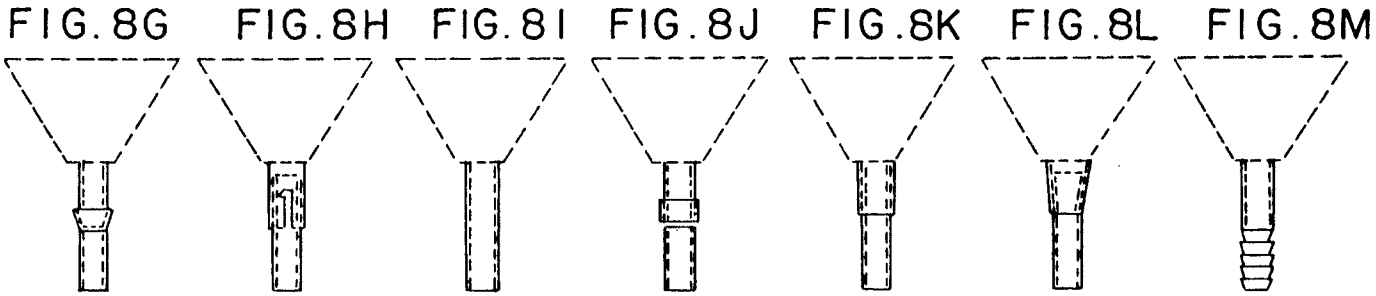
FIG. 8G
FIG. 8H
FIG. 8I
FIG. 8J
FIG. 8K
FIG. 8L
FIG. 8M
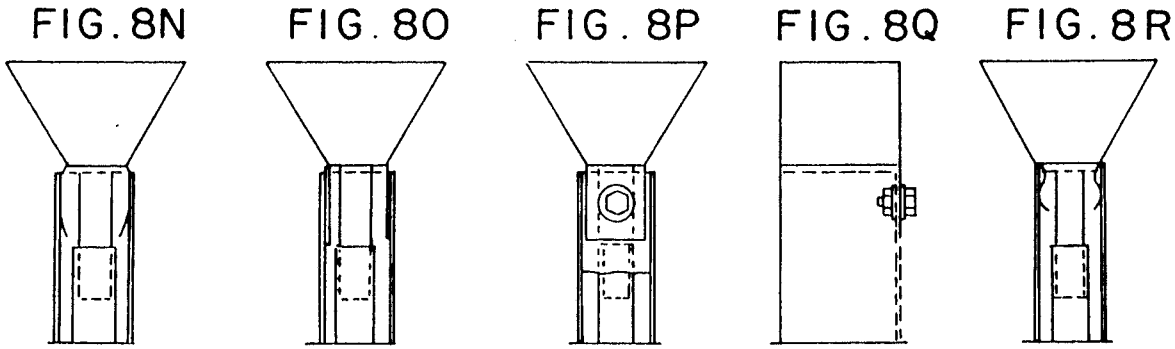
FIG. 8N
FIG. 8O
FIG. 8P
FIG. 8Q
FIG. 8R

ELECTROLYZER

STATE OF THE ART

It is well known in the different technologies of the chlor-alkali industry (mercury cathode, diaphragm and membrane electrolyzers) that there are problems connected with mass transfer and gas development at the electrodes, particularly at the anodes. In the industrially important case of sodium chloride electrolysis in diaphragm electrolyzers, ever increasing efforts have been made, during the last two decades to improve the process, in particular to increase the current density and to reduce the anode-to-diaphragm gap.

The introduction of dimensionally stable metal anodes as a substitute for graphite and the use of diaphragms based on asbestos and polytetrafluoroethylene, applied to the cathode by new techniques resulted in an increase of the current density from about 1.5 kA/m2 to about 2.7 kA/m2 and in a reduction of the distance between the anode and the diaphragm from 7–10 mm to 1–2 mm. Under these operating conditions, an efficient mass transfer to the surface of the anode by maintaining a high chloride concentration in the reduced anode-to-diaphragm gap and minimizing the amounts of gas bubbles sticking to the anode is of the outmost importance.

The effects of a scarce chloride ion supply and an insufficient gas bubbles elimination at the anode result in: a cell voltage increase; a decrease of the faradic efficiency; the development of parasitic reactions leading to pollution of products; a reduction of the electrocatalytic activity and of the anode lifetime; decrease of the diaphragm lifetime; and dangerous operation of the electrolyzers. If the above problems are not overcome, not only is the efficiency of a diaphragm electrolyzer considerably reduced but any further development is inhibited.

FIGS. 1 and 2 are two cross-sectional, longitudinal and transversal views respectively, of a typical prior art electrolyzer comprising: a base (A) on which dimensionally stable anodes (B) are secured. The number of the anodes depends on the electrolyzer dimensions. A shell acts as a current distributor (R) whereto cathodes made of a very fine iron mesh are welded; an asbestos diaphragm or the like is deposited on the cathodic mesh by means of special procedures (not represented in FIG. 1 and 2) and a cover (G) is made of polyester or other chlorine resistant material. The cathodic compartment is constituted by the space confined between the mesh supported diaphragm and the shell (R), while the anodic compartment is constituted by the remaining part of the volume of the electrolyzer where the anodes are fitted in.

The operation of the electrolyzer can be described as follows: the brine (300 grams/liter of sodium chloride), that is the anolyte, enters from the brine inlet (M) into the anodic compartment and is electrolyzed at the anodes (B) where chlorine is evolved and released through the outlet (H); the depleted brine flows through the diaphragm into the cathodic compartment where it is electrolyzed at the cathodes (C) evolving hydrogen which is released through (I); the electrolyzed brine, constituting the catholyte, (160–190 grams/liter of sodium chloride and 120–150 grams/liter of caustic soda) is collected through the percolating pipe (L); the flow rate of the anolyte from the anodic compartment to the cathodic compartment through the diaphragm is adjusted by varying the height of the percolating pipe (L); the driving force of the brine flow through the diaphragm being provided by the hydraulic head (N) which develops between the anolyte and the catholyte.

However, this type of electrolyzer is affected by several inconveniences when efforts are directed to a) increase the specific productivity by increasing the current density; b) reduce the interelectrodic gap to reduce energy consumption; c) increase the concentration of caustic in the catholyte to reduce steam consumption in the concentration step; d) extend the operating times to reduce maintenance costs and pollution problems essentially linked to asbestos, which is still today the main component of the diaphragms. Reducing asbestos manipulation frequency is nowadays an aim of the outmost industrial importance.

The disadvantages are mainly caused by the problems connected with both the supply of fresh brine to the anode-diaphragm gap and the elimination of the gas bubbles which collect in said gap. An insufficient supply of fresh brine involves the following parasitic phenomena: local increase of pH in the anodic compartment due to the back-migration of hydroxyl ions from the cathodic compartment; water electrolysis with oxygen production and reduction of the anodic efficiency; formation of hypochlorates and chlorates which diffuse through the diaphragm from the anodic compartment into the cathodic compartment which are transformed into chloride at the cathodes with the reduction of the cathodic faradic efficiency; and gas bubble effect, that is the chlorine gas bubbles formed at the anode fill the anodic compartment causing localized increase of the electrolyte resistance, current imbalance leading to an increase of the local current density in the electrolyte and in the diaphragm and an increase of the electrolyzer voltage. These problems are enhaced when the total electric load is increased and even more when the interelectrodic gap is reduced. The most critical conditions are encountered in the so-called zero-gap cells where the anodes are in direct contact with the diaphragm.

Many efforts have been made to find a solution to these problems and a voluminous literature and many patents exist wherein different solutions are proposed to improve the mass transfer, either by special open mesh electrodic structures favouring gas release, or by means of hydrodynamic baffles. The latter, opportunely conveying the gas bubbles evolved at the electrodes, induce a pumping effect of the electrolyte in the interelectrodic gap and decrease the gas bubble effect. U.S. Pat. No. 4,035,279 although especially directed to mercury cells, describes the use of slanting baffles (FIG. 5 of said patent) in diaphragm cells operating with graphite anodes. FIG. 3 of the present application describes this prior art electrolyzer wherein the pair of slanting baffles intercepts the gas which is conveyed in (Q) making a sort of chimney, the gas volume withdrawing more electrolyte through the cell perimeter (T). Therefore a lifting motion of the electrolyte and gas in (Q) and a downward motion of electrolyte in (T) are provided. However no industrial application of this system is known after more than 10 years from filing of the patent. In fact the effectiveness of this method is negatively affected by the following drawbacks: a) the upward and downward motions are formed contemporaneously in the anode-to-diaphragm gaps. The upward motions have a positive effect as they improve the gas release and the rising speed of the electrolytes; conversely the downward motions have an adverse effect as they are opposed to the rising flow of gas; b) to reduce the negative effect, the downward motions must be numerically limited and localized in in the peripheral areas of the electrolyzer so that they affect a minor portion of the total anodic surface. As a result the total flow rate of the downward motions is also limited and upward motions of the electrolyte are not evenly distributed and mostly localized near the downward motion; c) the anode diaphragm gap cannot be reduced as it would increase the pressure drops; in this case, the pumping effect would become less effective and the electrolyte would enter preferentially through the lateral upper part of the chimney through the two triangular cross sections formed by the baffles and by the imaginary horizontal line orthogonal to the upper part of the electrodes.

FIG. 4 shows the structure of dimensionally stable anodes (detail 2), which have since been long substituted for graphite anodes (detail 1). As it can be seen, the metal anodes have a hollow structure in the form of a box made by folding an expanded metal sheet. Using these anodes would make the improvement taught by U.S. Pat. No. 4,035,279 even more ineffective as the upward motions would be concentrated in the hollow part of the anode (i.e. 44 mm thickness) where the pressure drops are lower.

In conclusion the said patent is not only scarcely effective in diaphragm cells operating with graphite anodes, but decidedly ineffective with metal anodes for the following reasons: a) presence of areas where the downward motions are opposed to the upward motions of the gas bubbles; b) the downward motions are limited to the peripheral area of the electrolyzer and not uniformly distributed, thus negatively affecting operation; c) the upward flow essentially goes through the hollow part of the anodes where minimum pressure drops are met; d) part of the downward motions enter through the top lateral part of the chimney through the two triangular areas limited by the baffles and by the imaginary horizontal line orthogonal to the upper part of the electrodes; e) the elevation of the slanting baffles is added t the height of the anodes and their slope is therefore modest as to avoid emerging of the baffles out of the brine level, thus losing effectiveness; f) the modest slope limits the available hydraulic lift as most of the kinetic energy is lost in the collision of the vertical flow of the gas-liquid dispersion and the baffles.

OBJECTS OF THE INVENTION

It is an object of the invention to provide an improved monopolar electrolytic cell and an anode with improved mass transfer.

It is another object of the invention to provide an improved electrolysis method.

These and other objects and advantages of the invention will become obvious from the following detailed description.

SUMMARY OF THE INVENTION

The novel monopolar diaphragm or pocket-type ion exchange membrane electrolyzer of the invention for chlor-alkali electrolysis comprises cathodic compartments and anodic compartments containing respectively cathodes and anodes having an open structure and elongated in a substantially vertical direction, the improvement comprising at least part of said anodes being provided in the upper part with baffles to generate a plurality of upward recirculation motions of the anolyte-gas mixed phase and downward motions of the gas-free anolyte to decrease the electrolyzer voltage and to increase the faradic efficiency and the quality of the products, said upward and downward motions localized in separate areas of the anodes, said baffles being provided with upper edges or overflow holes below the anolyte surface.

DESCRIPTION OF THE INVENTION

According to the present invention, the shortcomings of the prior art are overcome, especially as concerns either new or existing monopolar diaphragm electrolyzers using dimensionally stable anodes. However, the present invention is also advantageous for pocket-type membrane cells.

BRIEF DESCRIPTION OF THE DRAWINGS:

FIGS. 5, 6, 7, 8, 9 and 10 illustrate the present invention.

In these FIGURES, a series of baffles (D) are positioned on the electrodes, parallel or orthogonal to the anodic surface. In the former case, each pair of baffles fixed to an anode, has symmetrical edges with respect to a center plane defined by the anodic surface which baffles intercept and concentrate in (P) the uprising lift of the gas bubbles evolved at the anodic surface causing therefore an ascensional motion of the electrolyte/gas mixed phase which, from the base (A) of the cell through the space (S) between the diaphragm (F) and the anodic surface (B) is conveyed in (P) and a downward motion of the electrolyte free of gas which starting from the space defined by each pair of baffles (D) goes down through the brine conveyers (E) to the bases of the anode (B) and of the cell (A). As a main consequence, upward and downward motions are localized in separated areas of the anodes and do not interfere with each other.

The upward motions may be substantially concentrated in space (S) comprised between diaphragm (F) and anode (B), when the anodes made of expanded metal sheet and box shaped with rectangular section have the bottom section closed by a strip of sheet or of fine mesh (Y). In this last case, the strip (Y) may be replaced by the folded end of the fine screens which are spot-welded on to the surfaces of exhausted anodes during retrofitting operations. The hydraulic pressure provided by each pair of baffles and represented by the different density of the columns of uprising fluid (brine and gas) and of descendent fluid (brine) not only is exploited to generate recirculation of the electrolyte but also to increase the evacuation speed of the gas bubbles which evolve at the anode surface and would concentrate in space (S). Moreover, the disadvantages of a non-uniform and scarcely effective electrolyte recirculation, typical of the prior art, are avoided.

The baffles are preferably made of titanium sheets, for instance 0.5 mm thick shaped as shown in FIG. 8, details 8A to 8F but other chlorine-resistant materials may also be used. The baffles are fixed to the anodes as shown in said FIG. 8, details 8H to 8J and the baffles are connected to conveyers (E) as shown in FIG. 8, details 8K to 8R; electrolyte conveyers (E) made of chlorine resistant material may vary as to number, shape and dimensions (cylindrical, oval, rectangular, etc. shaped pipes) depending on the anode characteristics and they are vertically positioned in the internal part of the anode. The conveyers length is half the height of the anodes or more.

Figure 1:
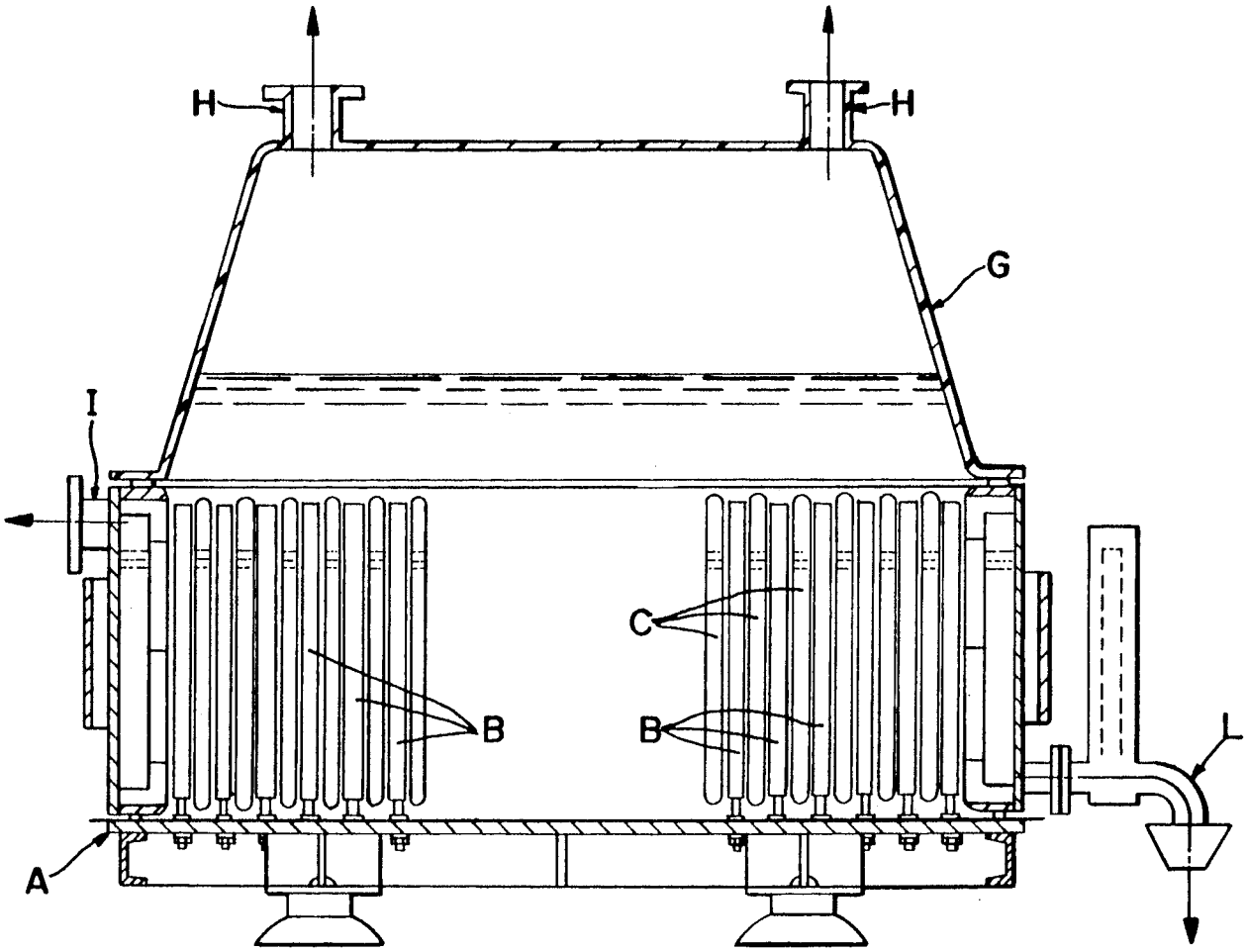
FIGS. 1–4 illustrate the prior art.
Figure 2:
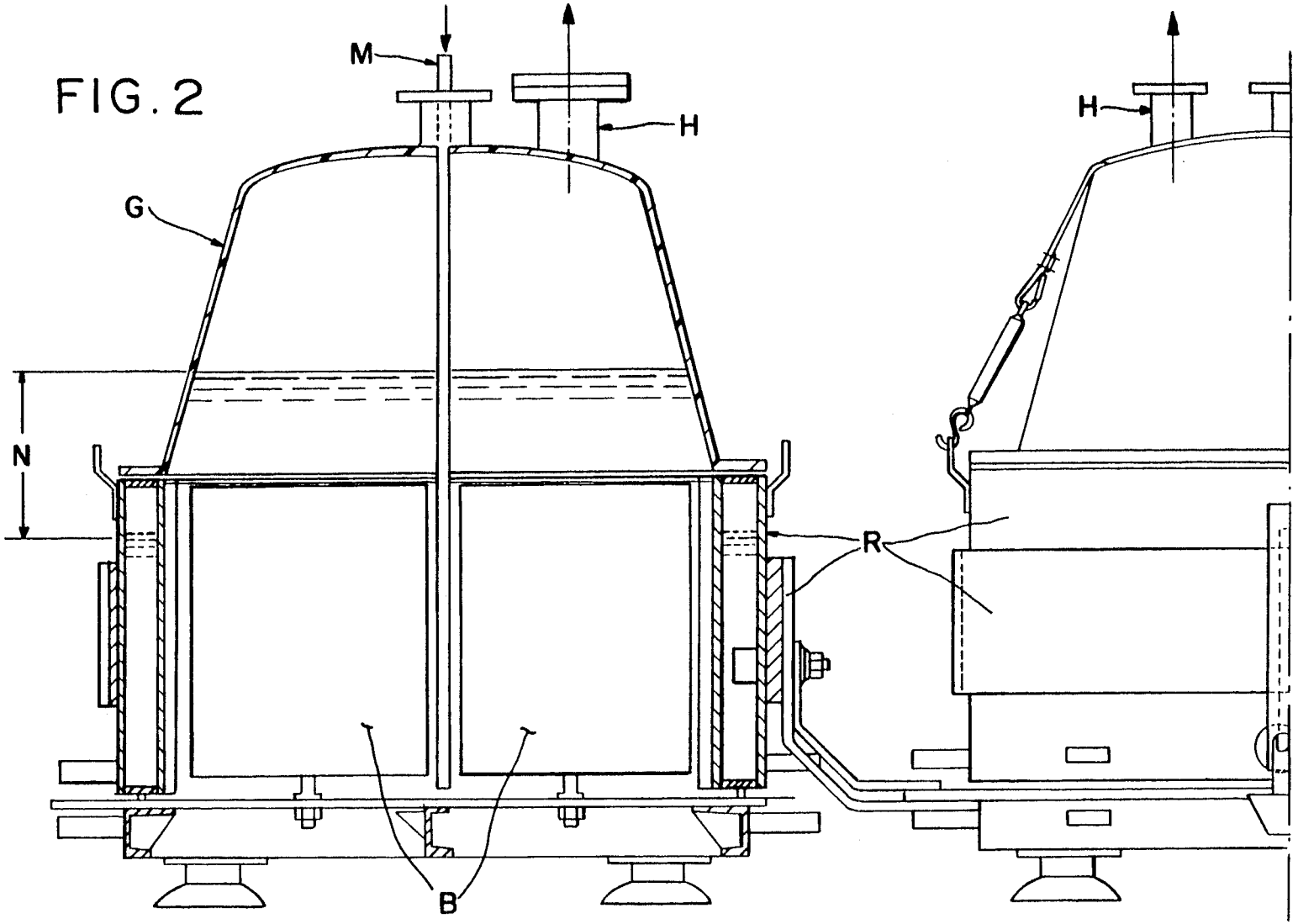
Figure 3:
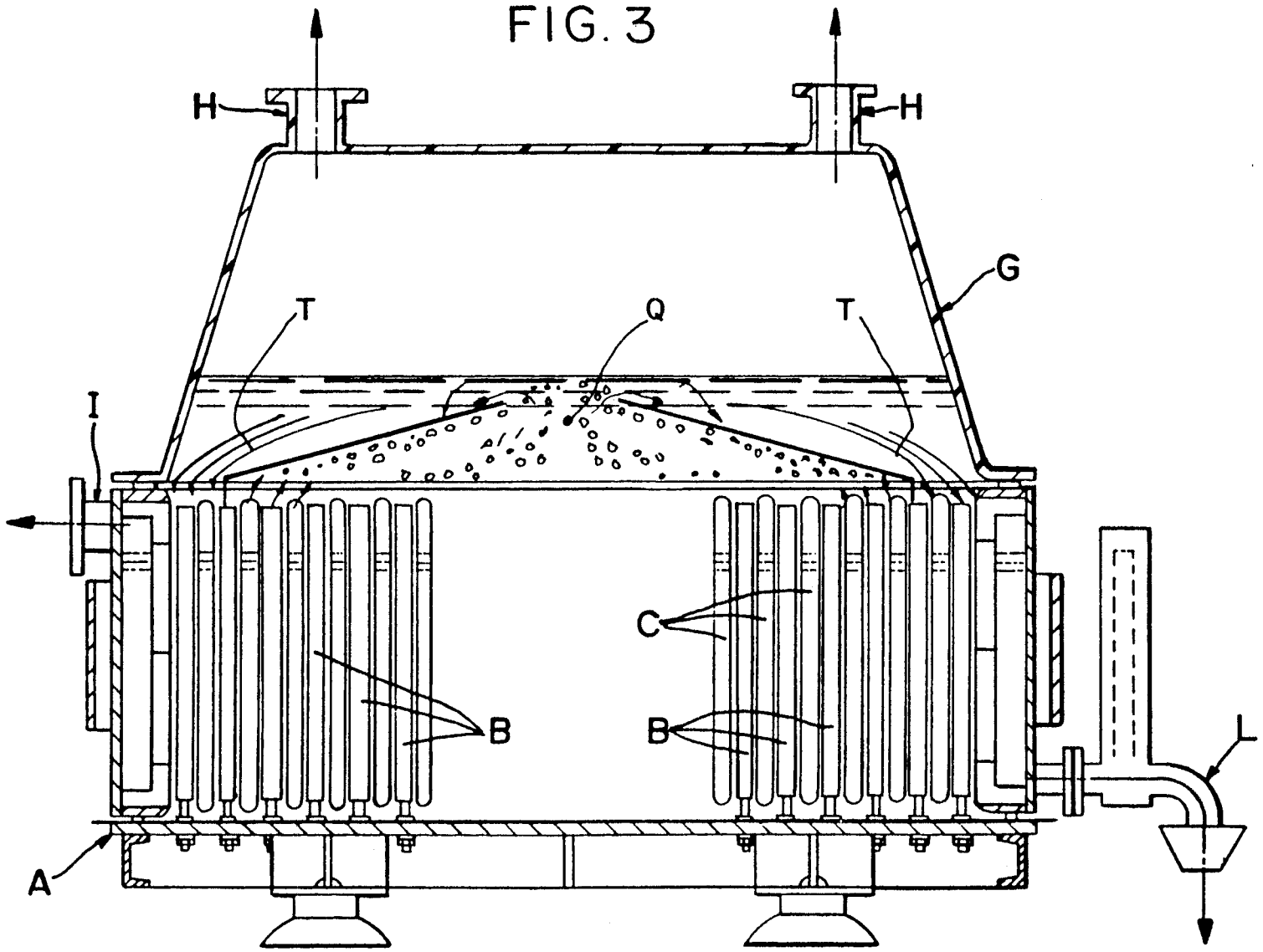
Figure 4:
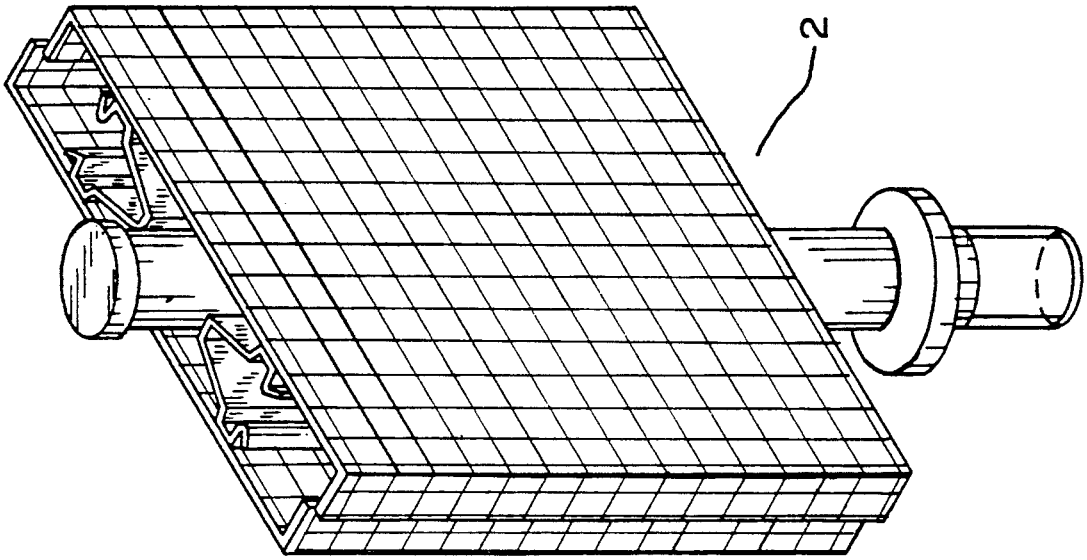
Figure 4:
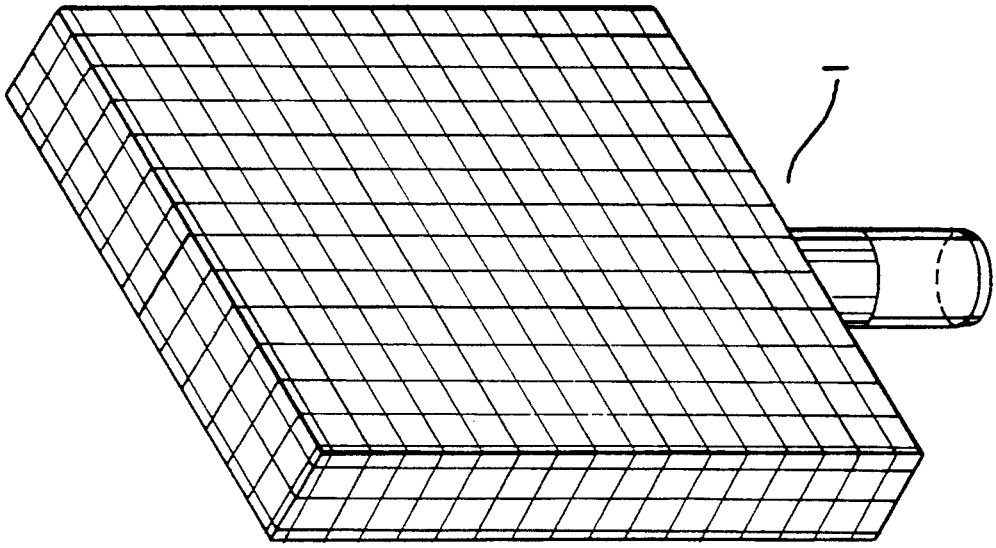
Figure 5:
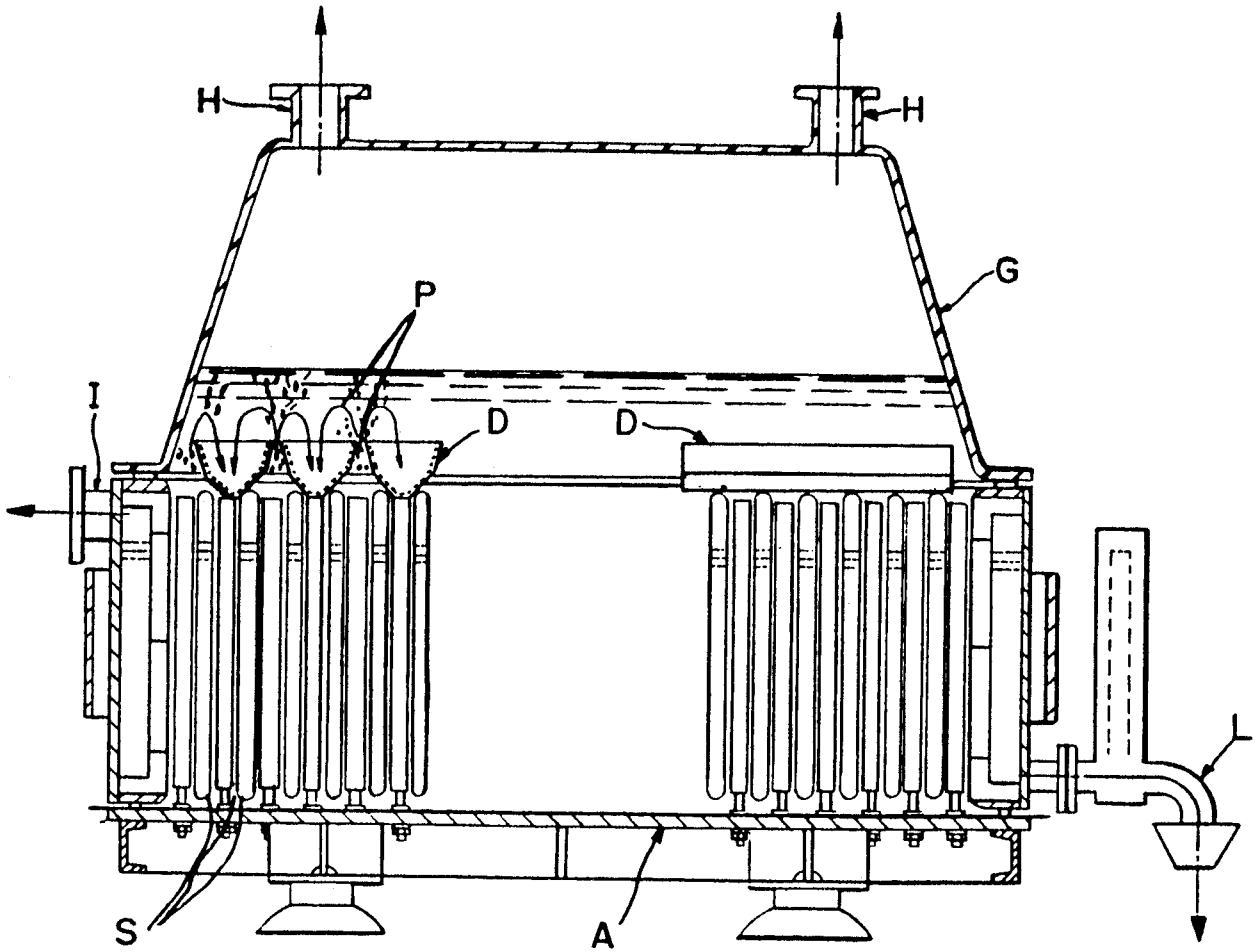
Figure 6:
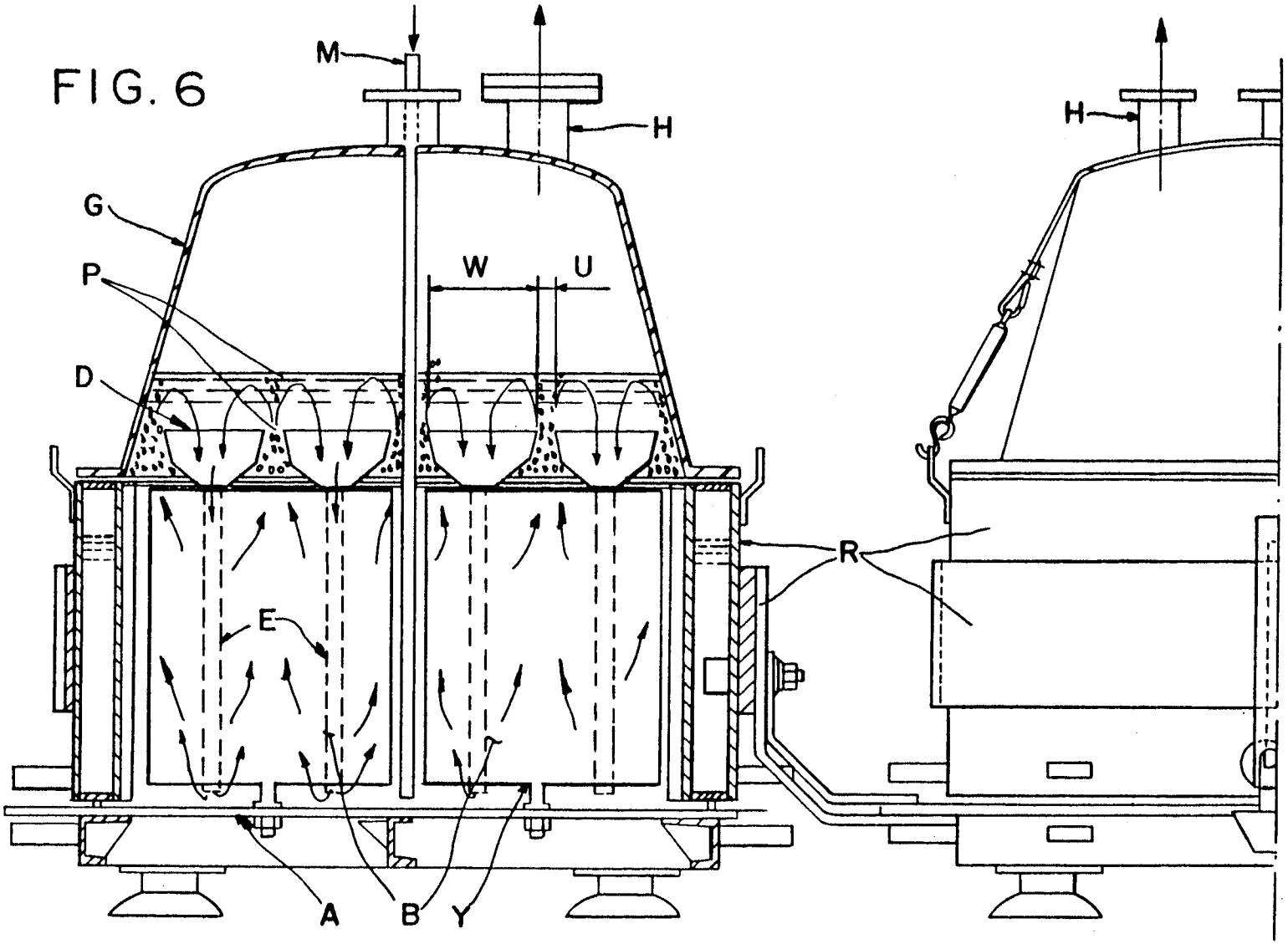
Figure 7:
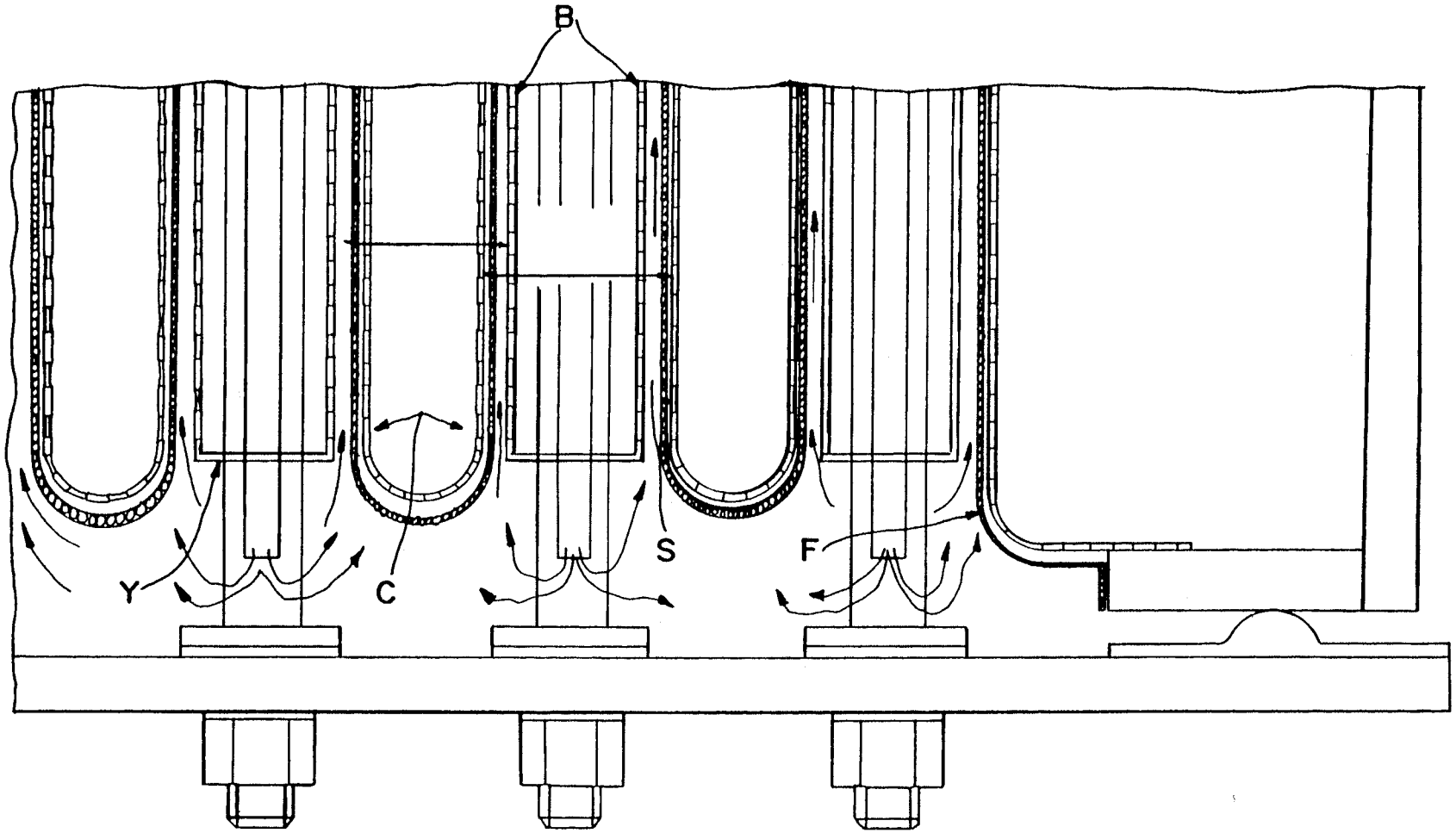

The distance (U) (FIG. 9) between two subsequent pairs of baffles may vary and may be comprised between 10 and 100 mm depending on the current density, anode dimensions, distance between anode-diaphragm and desired upward flow rate. In any case, the preferred ratio among the areas defined by the length of the baffles multiplied by widths (W) and (U) respectively (FIG. 9) is equal to or greater than 1. The height of each baffle (V) (FIG. 9) may vary and depends on the brine level on the anode. It is important that the top end of the baffles be positioned always under the brine level and as an alternative, the baffles may be provided with overflow holes. The orientation of the baffles has been shown as orthogonal to the length of the cell (FIG. 5), but also a parallel orientation (FIG. 6) is possible without appreciable variations in the operation efficiency.

In the following example there are described several preferred embodiments to illustrate the invention. However, it is to be understood that the invention is not intended to be limited to the specific embodiments.

EXAMPLE

Figure 9:
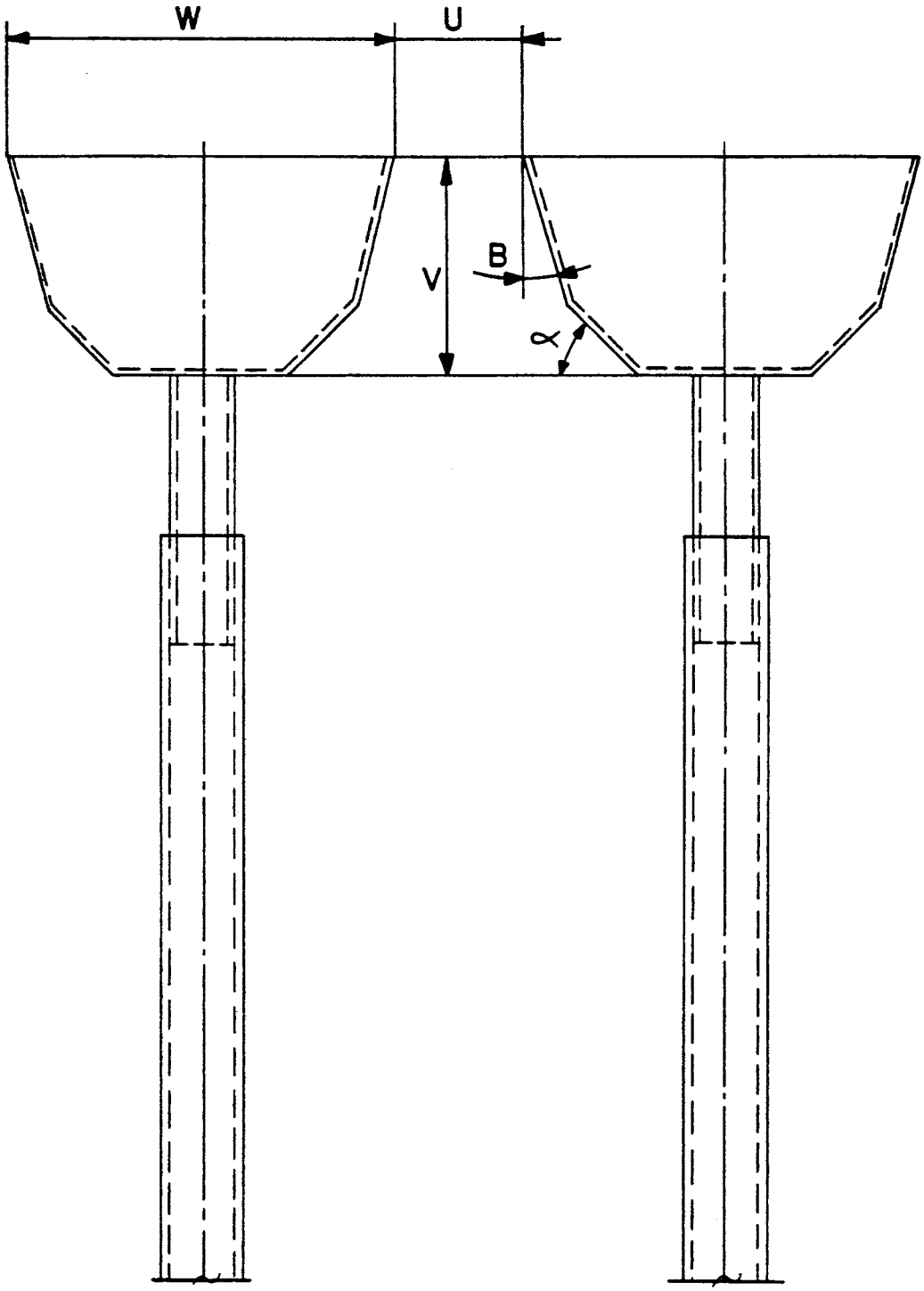
Figure 10:
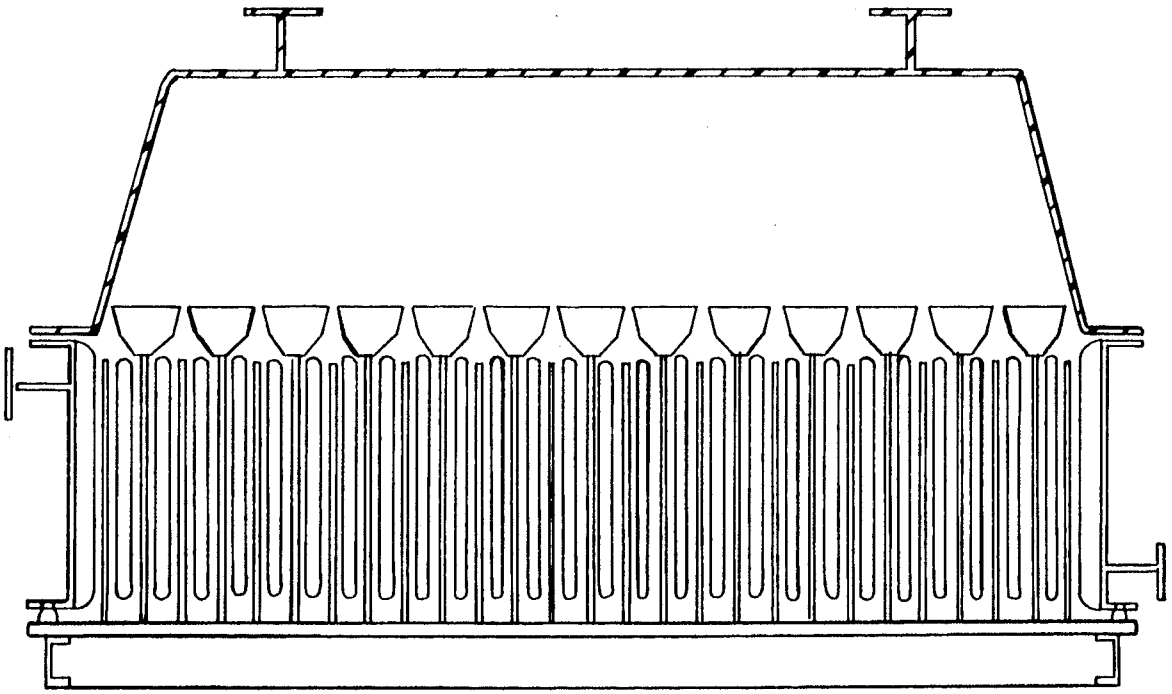

In a MDC 55 diaphragm electrolyzer (FIG. 10), provided with dimensionally stable anodes, 13 pairs of baffles made of titanium sheet 0.5 mm thick, as shown in FIG. 9, were installed. The height (V) of the baffles and the distance (U) (FIG. 9) between two subsequent pairs of baffles were respectively 200 and 30 mm. The and angles (FIG. 9) comprised between the two sloped surfaces and respectively the tangent at the bases of the baffle and the vertical axis were 30° and 70°. The electrolyte was brine containing 310 g/l of sodium chloride and the current density 2.5 kA/m2 ; referred to the anodic surface. The data obtained after extended operation in two twin electrolyzers of the same plant, one provided with the baffles of the invention and the other without, are reported in the following table.

TABLE

| Average value | electrolyzer without baffles | electrolyzer with baffles |
|---|---|---|
| Electrolyzer voltage | 3,43 V | 3,35 V |
| Brine concentration | 310 g/l | 310 g/l |
| Brine temperature | 88° C. | 88° C. |
| Catholyte | 190 g/l NaCl<br>120 g/l NaOH | 180 g/l NaCl<br>135 g/l NaOH |
| O2 content in Chlorine | 4,8% | 2,2% |
| Diaphragm life | 360 days (*) | 630 days (**) |
| Faradic efficiency | 90% | 95% |

(*) electrolyzer shut down and disassembled due to both the collapse of the faradic efficiency and the increase of the oxygen content in chlorine up to unbearable limits (more than 5%).
(**) electrolyzer still under operation at the time of filing of the priority application.

The comparison with the operating data clearly shows that the use of the hydrodynamic baffles of the invention provides for a remarkable decrease of the electrolyzer voltage, a drastic reduction of the quantity of oxygen in the chlorine with the consequent increase of the faradic efficiency and finally a considerable increase of the electrolyzer lifetime.

Various modifications of the cell and method of the invention may be made without departing from the spirit or scope thereof and it is to be understood that the invention is to be limited only as defined in the appended claims.

What is claimed is:

1. In a zero-gap monopolar diaphragm or pocket-type ion exchange membrane electrolyzer for chlor-alkali electrolysis, said electrolyzer comprising cathodic compartments and anodic compartments separated by a diaphragm or pocket-type ion exchange membrane containing respectively box-shaped expanded metal cathodes and anodes having an open structure and elongated in a substantially vertical direction, the improvement comprising at least part of said anodes are provided in the upper part with baffles to generate a plurality of upward recirculation motions of the anolyte-gas mixed phase and downward motions of the gas-free anolyte through electrolyte conveyors to decrease the electrolyzer voltage and to increase the faradic efficiency and the quality of the products, said upward and downward motions localized in separate areas of the anodes, said baffles being provided with upper edges of overflow holes in the lower portion of the baffle.

2. The electrolyzer of claim 1 wherein the anodes are box shaped, fixed or expandable.

3. The electrolyzer of claim 2 wherein the anodes have an activated fine screen applied thereto.

4. The electrolyzer of claim 1 wherein the baffles are provided with electrolyte conveyers connected thereto and positioned inside said anodes to convey downward motions towards the base of said anodes for a substantial portion of their height.

5. The electrolyzer of claim 2 wherein the lower part of said anodes is closed with a strip of sheet or with a strip of fine mesh to concentrate the upward motions nearby the diaphragm or membrane.

6. The electrolyzer of claim 3 wherein the lower part of the said anode is closed by the folded end of the activated fine screen to concentrate the upward motions nearby the diaphragm or membrane.

7. The electrolyzer of claim 1 wherein the baffles are fixed two by two and each pair of baffles is mechanically secured to the upper part of said anodes and provided with sloped surfaces of each pair of baffles which are symmetrically disposed with respect to a center plane defined by the anodic surfaces; the ratio between the width of each pair of baffles and the distance between two subsequent pairs of baffles is at least equal to 1, said width and the distance between two subsequent pairs of baffles is at least equal to 1, said width and distance being measured in relation to the upper edges of said overflow holes.

8. The electrolyzer of claim 1 wherein all the anodes are provided with said baffles.

9. The electrolyzer of claim 1 wherein the anodes are alternatively provided with said baffles.

10. The electrolyzer of claim 1 wherein the planes defined by the surfaces of the anode are parallel to the length of said baffles.

11. The electrolyzer of claim 1 wherein the planes defined by the surfaces of the anode are orthogonal to the length of said baffles.

12. A box-like anode having an open structure and elongated in a substantially vertical direction provided in localized areas of the upper part thereof with baffles provided with upper edges with overflow holes in the lower portion of the baffle to generate upward and downward motions in separate areas of the anode and electrolyte conveyor connected to the baffles and positioned inside said anode to convey downward motions towards the base of said anode for a substantial portion of their height.

13. The anode of claim 12 wherein the anodes are box-shaped, fixed or expandable.

14. The anode of claim 12 wherein the anodes have an activated fine screen applied thereto.

15. The anode of claim 14 wherein the lower part of the said anode is closed by the folded end of the activated fine screen.

16. The anode of claim 12 wherein the lower part of said anode is closed with a strip of sheet or with a strip of fine mesh.

17. The anode of claim 12 wherein the baffles are fixed two by two and each pair of baffles are fixed two by two and each pair of baffles is mechanically secured to the upper part of said anodes; the sloped surfaces of each pair of baffles are symmetrically disposed with respect to a center plane defined by the anodic surfaces; the ratio between the width of each pair of baffles and the distance between two subsequent pairs of baffles is at least equal to 1, said width and distance being measured in relation to the upper edges of said overflow holes.

* * * * *